United States Patent [19]

Rohner

[11] Patent Number: 4,545,484

[45] Date of Patent: Oct. 8, 1985

[54] FILING CASE

[75] Inventor: Benedikt Rohner, Zürich, Switzerland

[73] Assignee: Biella-Neher AG., Biel, Switzerland

[21] Appl. No.: 619,910

[22] Filed: Jun. 12, 1984

[30] Foreign Application Priority Data

Jun. 13, 1983 [CH] Switzerland ..... 3246/83

[51] Int. Cl.[4] ..... B65D 85/57; B42F 17/12; B42F 7/12

[52] U.S. Cl. ..... 206/425; 206/44 B; 206/444; 220/22.2; 220/22.3; 220/22.4

[58] Field of Search ..... 206/425, 448, 444; 220/22.2, 22.3, 22.4

[56] References Cited

U.S. PATENT DOCUMENTS

| | | | |
|---|---|---|---|
| 3,358,692 | 12/1967 | Proulx | 220/22.3 |
| 3,540,786 | 11/1970 | Potter | 220/22.3 |
| 4,192,425 | 3/1980 | Landau et al. | 211/50 |
| 4,366,904 | 1/1983 | Roskvist | 220/22.3 |
| 4,498,583 | 2/1985 | Long et al. | 206/425 |

FOREIGN PATENT DOCUMENTS

| | | |
|---|---|---|
| 2727692 | 11/1978 | Fed. Rep. of Germany . |
| 97255 | 12/1922 | Switzerland . |

*Primary Examiner*—William T. Dixson, Jr.
*Attorney, Agent, or Firm*—Oblon, Fisher Spivak, McClelland & Maier

[57] ABSTRACT

The filing case is particularly suitable for filing diskettes and has a plurality of divider plates spaced one behind the other, provided with projecting labelling tabs and, together with parts of the case bottom and sidewalls, bounding a filing compartment. Each divider plate has two mutually resilient legs, the free ends of which can be inserted in slots in the case bottom, the slots associated with the legs of an individual divider being disposed in a straight line. In order particularly to save on material, the divider plates are disposed in even numbers, are formed identically to one another, and are narrower than the distance between two sidewalls by at least approximately the width of a labelling tab.

2 Claims, 3 Drawing Figures

FILING CASE

This invention relates to filing equipment, and more particularly to a filing case, especially suitable for diskettes, of the type having a bottom, sidewalls, and a plurality of divider plates spaced one behind the other, provided with projecting labelling tabs and, together with parts of the case bottom and sidewalls, bounding a compartment, each divider plate being provided with two mutually resilient legs, i.e., which can be resiliently moved toward one another, the free ends of which are insertable in slots in the case bottom, the slots associated with the legs of an individual divider plate lying in a straight line.

Besides the possiblity of providing an arrangement which is easy to take in at a glance, an important factor in file receptacles having a number of dividers, particularly a large number of them, is the cost price of the individual dividers. Production costs can be reduced by making it possible to use dividers which are identical in shape, and by using a shape which furthermore offers savings on material.

Filing cases of the foregoing type have been disclosed, e.g., in German Disclosed Application (DOS) No. 27 27692, and have dividers corresponding substantially in width to the distance between the two sidewalls. One drawback of such filing cases is that no appreciable saving on material is possible. Although the dividers are all identical, their symmetrical shape leads to an expenditure of material which it is intended to avoid by means of the present invention.

It is an object of this invention to provide an improved filing case which is very economical as compared with comparable file receptacles and can be made of a suitable plastic material.

To this end, in the filing case according to the present invention, of the type intially mentioned, the dividers formed identically to one another and asymmetrically and disposed in an even number are narrower at least approximately by the width of a labelling tab than the distance between two sidewalls.

A preferred embodiment of the invention will now be described in detail with reference to the accompanying drawing, in which.

Figure 1:
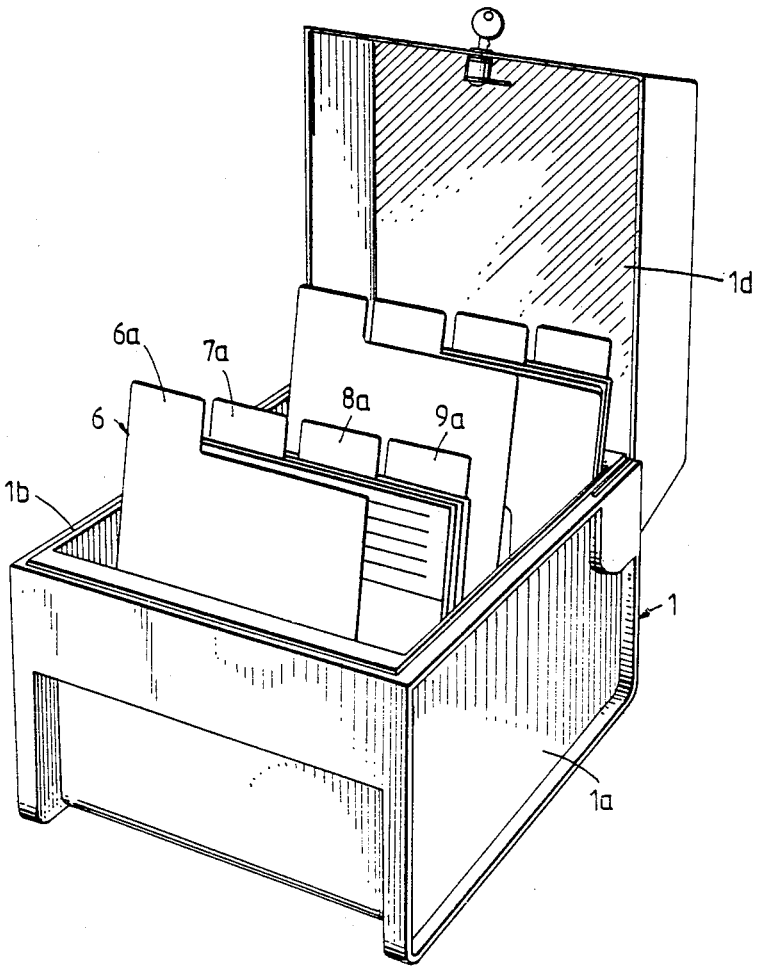
FIG. 1 is a perspective view of such a filing case.

The embodiment illustrated, which is a filing case for diskettes or floppy disks, essentially comprises a box 1 having sidewalls 1*a* and 1*b*, a bottom 1*c*, and a hinged lid 1*d*, the latter being swivel-mounted in the two opposite sidewalls 1*a* and 1*b* for the purpose of closing and locking the filing case as a whole.

In case bottom 1*c* there are rows of slots 2*a*, 2*b*, 3*a*, 3*b*, 4*a*, 4*b*, 5*a*, 5*b*, two slots each being disposed in straight lines 2 to 5, the individual lines 2–5 being situated one behind the other, and slots 2*a*, 2*b*, 3*a*, 3*b*, 4*a*, 4*b*, 5*a*, 5*b* disposed in adjacent lines 2–5 being mutually offset. In the embodiment illustrated, it would also be possible to provide four slots in each straight line 2 to 5, in which case these slots would not be thus staggered but situated one behind the other in rows.

The compartments which are intended and suitable for receiving one filed diskette each are formed by dividers 6 to 9 (only the labelling tabs 8*a* and 9*a* of dividers 8 and 9 are visible in the drawing) together with the portions of case bottom 1*c* situated between the planes of the respective dividers and the two case sidewalls 1*a* and 1*b*.

Each divider 6–9 includes two downwardly projecting legs (designated as 1O*a*, 1O*b*, 11*a*, and 11*b* for dividers 6 and 7, respectively), a recess 12 between these legs, and a labelling tab, 6*a*–9*a*, disposed at one end of the top edge of each divider, projecting beyond that edge. The outer edge of each leg is further provided with a notch 13, these notches being designed to engage side edges of slots 2*a* to 4*b*.

Through the selection of a suitable plastic as the material of which dividers 6 to 9 are made, and of recess 12 between legs 1O*a* and 1O*b* of a divider, a resilient deformation is made possible in the sense that with application of force, the legs can be moved closer to each other in the plane of the respective divider by a certain amount, the dimensions being such that after such deformation, the two legs can be inserted in their proper slots, and the slot edges facing away from each other enter notches 13 of the respective legs for the purpose of fixing the position of the dividers after the application of force has ceased.

Figure 2:
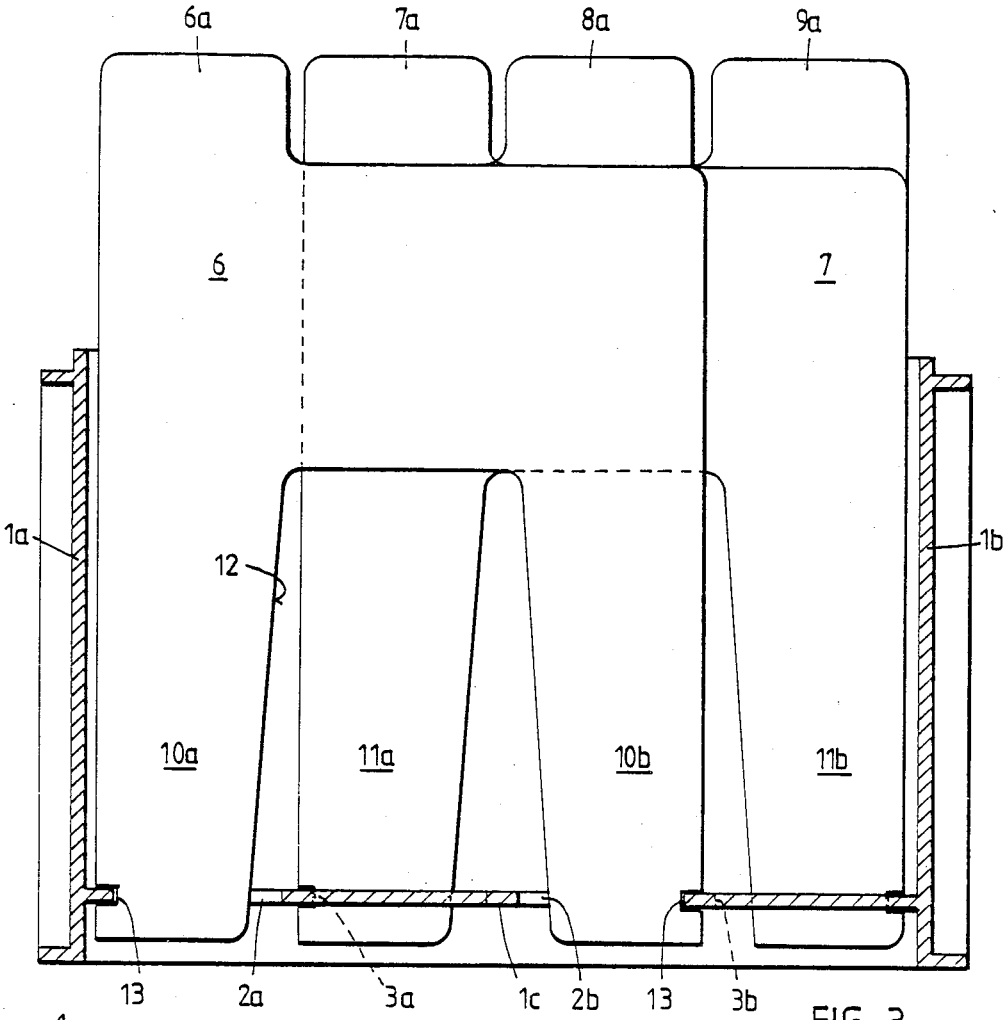
FIG. 2 is a section, on a larger scale, taken on the line II—II of FIG. 3 through the first row of slots.

The dimension of mutual offsetting of slots 2*a* to 5*b* of adjacent straight lines 2 to 5 corresponds at least approximately to the width of labelling tabs 6*a* to 9*a*, so that the tabs of adjacent dividers 6–9, the legs of which are inserted in the same of a straight line 2 to 5, come to lie next to one another. Analogous relative position of tab 8*a* and 9*a* are achieved by turning the third and fourth dividers around, i.e., reversing their orientation by 180°, before inserting them in slots 4*a*–4*b* and 5*a*–5*b*, respectively. Because all the dividers are identical in shape and size, the tabs 6*a* to 9*a* of the four dividers illustrated assume the relative positions shown in FIGS. 1 and 2, i.e., the tabs form a row visible one next to another when the dividers are inserted as described one behind another.

In an embodiment having slots 2*a* through 5*b* not mutually offset, but in rows one behind the other, only the first and third slots of the first straight line 2 will be used, only the second and fourth slots in line 3, again the first and third slots of line 4, the second and fourth slots of line 5, etc., for inserting the legs of adjacent dividers.

Figure 3:
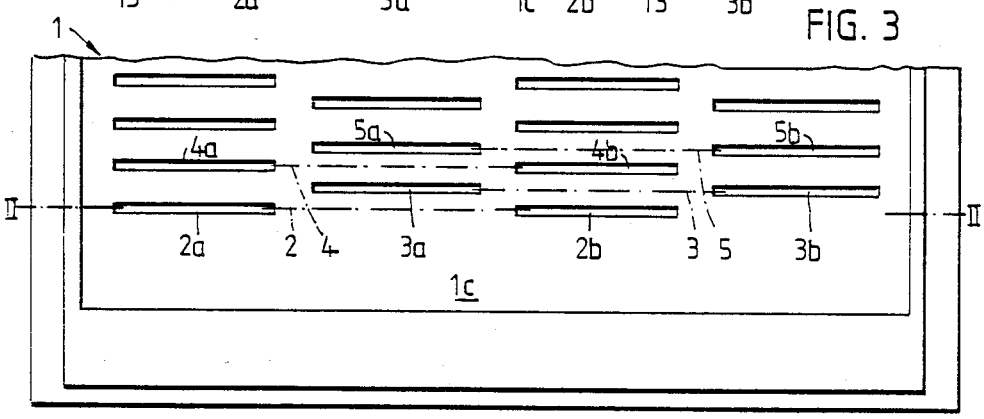
FIG. 3 is a top plan view of the case bottom on a larger scale.

An embodiment wherein the rows of slots are staggered as shown in FIG. 3 is, however, to be preferred because the space between slots can then be made very narrow (as is desirable for filing thin single objects such as diskettes) without weakening the portions of the case bottom subsisting between the individual slots. If all rows of slots are aligned, they cannot be disposed so close to one another as with a staggered arrangement.

Other possibilities would be to provide more than two slots per straight line 2 to 5, just as more than four dividers may be disposed to form a continuous row of labelling tabs, insofar as the number of the dividers whose labelling tabs come to be situated next to one another in a row is an even number.

The invention makes it possible to use identical dividers for a whole filing case, with some inserted as mirror images of the others. The reduction in production costs made possible by the identical size and shape of the dividers becomes even greater because of the recess provided to achieve the resilient properties of the divider legs inasmuch as this recess also represents a not inconsiderable saving on material.

What is claimed is:

1. A filing case, particularly for diskettes, of the type having a bottom including a plurality of slots therein, two sidewalls, and a number of dividers disposed spaced one behind the other, said dividers including projecting labelling tabs and portions insertable in said slots and, together with portions of said bottom and said sidewalls, bounding a plurality of filing compartments, said dividers each having two mutually resilient legs constituting said portions insertable in said slots, those of said slots associated with said legs of a single one of said dividers being situated in a straight line, wherein said dividers are identical and asymmetrical in shape, disposed in even numbers, and narrower than the distance between said two sidewalls by substantially the width of one of said labelling tabs.

2. The filing case of claim 1, wherein said slots of adjacent said straight lines are mutually offset by substantially the width of one of said labelling tabs.

* * * * *